US007624719B2

(12) United States Patent
Achleitner et al.

(10) Patent No.: US 7,624,719 B2
(45) Date of Patent: Dec. 1, 2009

(54) METHOD FOR CONTROLLING A FUEL SUPPLYING DEVICE OF AN INTERNAL COMBUSTION ENGINE

(75) Inventors: Erwin Achleitner, Obertraubling (DE); Martin Cwielong, Regensburg (DE); Gerhard Eser, Hemau (DE)

(73) Assignee: Siemens Aktiengesellschaft, Munich (DE)

( * ) Notice: Subject to any disclaimer, the term of this patent is extended or adjusted under 35 U.S.C. 154(b) by 469 days.

(21) Appl. No.: 11/547,941

(22) PCT Filed: Feb. 23, 2005

(86) PCT No.: PCT/EP2005/050769

§ 371 (c)(1),
(2), (4) Date: Oct. 6, 2006

(87) PCT Pub. No.: WO2005/098221

PCT Pub. Date: Oct. 20, 2005

(65) Prior Publication Data

US 2008/0269984 A1 Oct. 30, 2008

(30) Foreign Application Priority Data

Apr. 6, 2004 (DE) ..... 10 2004 016 943

(51) Int. Cl.
*F02M 1/00* (2006.01)
*F02M 41/00* (2006.01)

(52) U.S. Cl. ..... 123/456; 123/447; 123/458

(58) Field of Classification Search ..... 123/446, 123/447, 455, 456, 457, 458
See application file for complete search history.

(56) References Cited

U.S. PATENT DOCUMENTS 6,112,721 A * 9/2000 Kouketsu et al. ..... 123/447
6,494,182 B1 * 12/2002 Djordjevic ..... 123/456
6,637,408 B2 * 10/2003 Djordjevic ..... 123/456
6,712,045 B1 * 3/2004 McCarthy, Jr. ..... 123/456

FOREIGN PATENT DOCUMENTS

| | | | |
|---|---|---|---|
| DE | 195 48 278 | A1 | 6/1997 |
| DE | 197 31 102 | A1 | 1/1999 |
| DE | 198 53 823 | A1 | 5/2000 |
| DE | 199 03 272 | A1 | 8/2000 |
| DE | 199 16 101 | A1 | 10/2000 |
| DE | 100 57 244 | A1 | 6/2002 |
| DE | 101 49 237 | A1 | 4/2003 |
| EP | 1 327 766 | A2 | 7/2003 |
| WO | WO 03/023232 | A2 | 3/2003 |
| WO | WO 2004/104397 | A1 | 12/2004 |

* cited by examiner

*Primary Examiner*—John T Kwon
(74) *Attorney, Agent, or Firm*—King & Spalding L.L.P.

(57) ABSTRACT

Disclosed is a fuel supplying device of an internal combustion engine, comprising a low-pressure circuit, a high-pressure pump coupled to the low-pressure circuit and conveys fuel into a fuel reservoir, a volume flow control valve assigned to the high-pressure pump, an electromechanical pressure regulator connected to the fuel reservoir and the low-pressure circuit and can direct fuel from the fuel reservoir into the low-pressure circuit, a regulating mechanism which generates an actuation signal for the volume flow control valve by a first controller in a first mode which generating an actuation signal for the electromechanical pressure regulator with the aid of a second controller in a second mode. The mode of the fuel supplying mechanism is switched in accordance with a fuel pressure error value resulting from a detected fuel pressure and a predefined fuel pressure. The mode can additionally be switched according to the throughput of the high-pressure pump.

17 Claims, 5 Drawing Sheets

METHOD FOR CONTROLLING A FUEL SUPPLYING DEVICE OF AN INTERNAL COMBUSTION ENGINE

CROSS REFERENCE TO RELATED APPLICATIONS

This application is the US National Stage of International Application No. PCT/EP2005/050769, filed Feb. 23, 2005 and claims the benefits of German Patent application No. 10 2004 016 943.8 filed Apr. 6, 2004. All of the applications are incorporated by reference herein in their entirety.

FIELD OF THE INVENTION

The invention relates to a method for controlling a fuel supplying device of an internal combustion engine, the fuel supplying device comprising a low-pressure circuit, a high-pressure pump that is coupled to the low-pressure circuit at the input side and conveys the fuel into a fuel accumulator, a volume flow control valve associated with the high-pressure pump, and an electromechanical pressure regulator that is actively connected to the fuel accumulator and the low-pressure circuit and can stop the flow of fuel from the fuel accumulator into the low-pressure circuit.

BACKGROUND OF THE INVENTION

High demands are made on internal combustion engines, in particular in motor vehicles. The pollutant emissions are subject to legal regulations and the customer demands low fuel consumption, safe and reliable operation and low maintenance costs. The fuel supplying device of the internal combustion engine has a strong influence on whether the demands may be met.

DE 199 16 101 A1 discloses a method and a device for controlling an internal combustion engine. A high-pressure pump conveys fuel from a low-pressure region into a fuel accumulator. An actual value of a fuel pressure in the fuel accumulator is detected. In a first operating state the high-pressure pump is controlled as an actuator to adjust the fuel pressure in the fuel accumulator. In a second operating state a pressure relief valve is controlled as an actuator to discharge fuel from the fuel accumulator into the low-pressure region to adjust the fuel pressure. In the first operating state a control deviation between a desired value of the fuel pressure and the actual value of the fuel pressure is supplied to a first regulator. In the second operating state the control deviation is supplied to a second regulator. The first regulator is only used if the control deviation is positive. The second regulator is only used if the control deviation is negative. A switch takes place between the first operating state and the second operating state if the respectively active regulator reaches a zero control point and the control deviation is greater than a first threshold or the control deviation is less than a second threshold.

A method for operating an internal combustion engine is also disclosed in WO 2004/104397 A1 in which, in a first operating mode, a fuel pressure in a fuel accumulator is regulated to a desired pressure by adjusting a flow of fuel from fuel supplied to the high-pressure pump as a function of a volume of fuel to be injected and the desired pressure, and in which, in a second operating mode, with a specified flow of fuel, the fuel pressure is regulated to the desired value by discharging fuel from the fuel accumulator. The second operating mode is adopted if the flow of fuel falls below a first flow of fuel and the first operating mode is adopted if the flow of fuel exceeds a second flow of fuel.

SUMMARY OF THE INVENTION

The object underlying the invention is therefore to provide a method which allows reliable and safe operation of fuel supplying devices in internal combustion engines.

The object is achieved by the features of the independent claims. Advantageous developments of the invention are identified in the subclaims.

The invention is characterized by a method for controlling a fuel supplying device of an internal combustion engine, the fuel supplying device comprising a low-pressure circuit, a high-pressure pump that is coupled to the low-pressure circuit at the input side and conveys the fuel into a fuel accumulator, a volume flow control valve associated with the high-pressure pump, and an electromechanical pressure regulator that is actively connected to the fuel accumulator and the low-pressure circuit and can stop the flow of fuel from the fuel accumulator into the low-pressure circuit. In the method a control deviation is determined from a difference between a specified fuel pressure and a detected fuel pressure. In a first operating mode a regulating signal for the volume flow control valve is generated by means of a first regulator, the control deviation being supplied to the first regulator. In a second operating mode a regulating signal for the electromechanical pressure regulator is generated by means of a second regulator, the control deviation being supplied to the second regulator. There is a switch from the first operating mode to the second operating mode if the detected fuel pressure is greater than the specified fuel pressure by a first specified amount or a first specified factor. There is also a switch from the first operating mode to the second operating mode as a function of a delivery flow of the high-pressure pump, if the delivery flow of the high-pressure pump is less than a lower switch-over threshold of the delivery flow, and there is a switch from the second operating mode to the first operating mode if the delivery flow of the high-pressure pump is greater than an upper switch-over threshold of the delivery flow.

The method has the advantage that an excessive fuel pressure in the fuel accumulator may be avoided and a pressure relief valve, which may be provided on the fuel accumulator and discharges fuel from the fuel accumulator before the fuel pressure in the fuel accumulator become so great that the fuel supplying device could be damaged thereby, is protected from damage. A further advantage is that tolerances or defects in fuel supplying device components may be compensated which could otherwise cause incorrect fuel pressures in the fuel accumulator. Safe and reliable operation of the fuel supplying device is made possible thereby. It may also easily be ensured that the specified fuel pressure may be attained. This method is particularly efficient as only as much fuel is conveyed into the fuel accumulator by the high-pressure pump as is required for adjusting or maintaining the fuel pressure in the fuel accumulator.

A switch is advantageously made from the second operating mode to the first operating mode if the detected fuel pressure is less than the specified fuel pressure by a second specified amount or a second specified factor. This has the advantage that an insufficient fuel pressure in the fuel accumulator, which may lead to inadequate dosing of fuel into the cylinders of the internal combustion engine, may be avoided.

The invention is also characterized by a method for controlling a fuel supplying device of an internal combustion engine, the fuel supplying device comprising a low-pressure circuit, a high-pressure pump that is coupled to the low-pressure circuit at the input side and conveys the fuel into a fuel accumulator, a volume flow control valve associated with the high-pressure pump, and an electromechanical pressure regulator that is actively connected to the fuel accumulator and the low-pressure circuit and can stop the flow of fuel from the fuel accumulator into the low-pressure circuit. In the method a control deviation is determined from a difference between a specified fuel pressure and a detected fuel pressure. In a first operating mode a regulating signal for the volume flow control valve is generated by means of a first regulator, the control deviation being supplied to the first regulator. In a second operating mode a regulating signal for the electromechanical pressure regulator is generated by means of a second regulator, the control deviation being supplied to the second regulator. There is a switch from the second operating mode to the first operating mode if the detected fuel pressure is less than the specified fuel pressure by a second specified amount or a second specified factor. There is also a switch from the first operating mode to the second operating mode as a function of a delivery flow of the high-pressure pump, if the delivery flow of the high-pressure pump is less than a lower switch-over threshold of the delivery flow, and there is a switch from the second operating mode to the first operating mode if the delivery flow of the high-pressure pump is greater than an upper switch-over threshold of the delivery flow.

This method has the advantage that an insufficient fuel pressure in the fuel accumulator, which may lead to inadequate dosing of fuel into the cylinders of the internal combustion engine, may be avoided. The method also has the advantage that tolerances and defects in fuel supplying device components may be compensated. This makes safe and reliable operation of the fuel supplying device possible. It may also easily be ensured that the specified fuel pressure may be attained. This method is particularly efficient as only as much fuel is conveyed into the fuel accumulator by the high-pressure pump as is required for adjusting or maintaining the fuel pressure in the fuel accumulator.

The lower switch-over threshold of the delivery flow and the upper switch-over threshold of the delivery flow are advantageously determined from an error value of the flow of fuel which results from a leakage flow through the volume flow control valve in its closed position and a leakage flow from the fuel accumulator if the electromechanical pressure regulator is closed and no fuel is to be dosed. The fuel supplying device may be operated more efficiently if the error value of the flow of fuel is known and taken into account for control of the fuel supplying device. By taking into account the error value of the flow of fuel, tolerances and defects in fuel supplying device components and the leakage flow of the volume flow control valve may be compensated and hence reliable operation of the fuel supplying device may be ensured.

In a preferred development the error value of the flow of fuel is determined as a function of at least two fuel pressures, detected at an interval, which are detected in a third operating mode in which no fuel is to be dosed and the volume flow control valve and the electromechanical pressure regulator are controlled in such a way that the volume flow control valve and the electromechanical pressure regulator are closed. Very precise measurement of the error value of the flow of fuel is thus possible.

To determine the error value of the flow of fuel, the fuel pressure in the fuel accumulator is advantageously regulated to a first specified fuel pressure, so the control deviation is less than a specified threshold value, a first fuel pressure is detected, a third operating mode is adjusted and the operating mode switch-over is blocked, a second fuel pressure is detected, and the error value of the flow of fuel is determined as a function of a time and a difference between the second detected fuel pressure and the first detected fuel pressure. This method makes it possible to determine the leakage flow very easily.

The second fuel pressure is advantageously detected if the fuel pressure in the fuel accumulator is greater than or equal to a second specified fuel pressure, of which the value is greater than that of the first specified fuel pressure. This method is particularly efficient if the leakage flow of the volume flow control valve is very high and the fuel pressure in the fuel accumulator is rapidly increasing.

In a further advantageous embodiment the second fuel pressure is detected after a specified time has elapsed. This method is efficient if the leakage flow of the volume flow control valve is low or if there are leakages in the fuel supplying device, so the fuel pressure in the fuel accumulator increases only very slowly or potentially decreases.

A preferred development is characterized in that following a switch from the first operating mode to the second operating mode or from the second operating mode to the first operating mode, switch-over of the operating mode is blocked for at least one specified blocking time. This has the advantage that instable operating states as a result of frequent switching between operating modes may be avoided.

BRIEF DESCRIPTION OF THE DRAWINGS

Exemplary embodiments of the invention are described hereinafter with reference to the schematic drawings, in which.

Elements which have the same construction and function are provided with the same reference numerals in all figures.

DETAILED DESCRIPTION OF THE INVENTION

Figure 1:
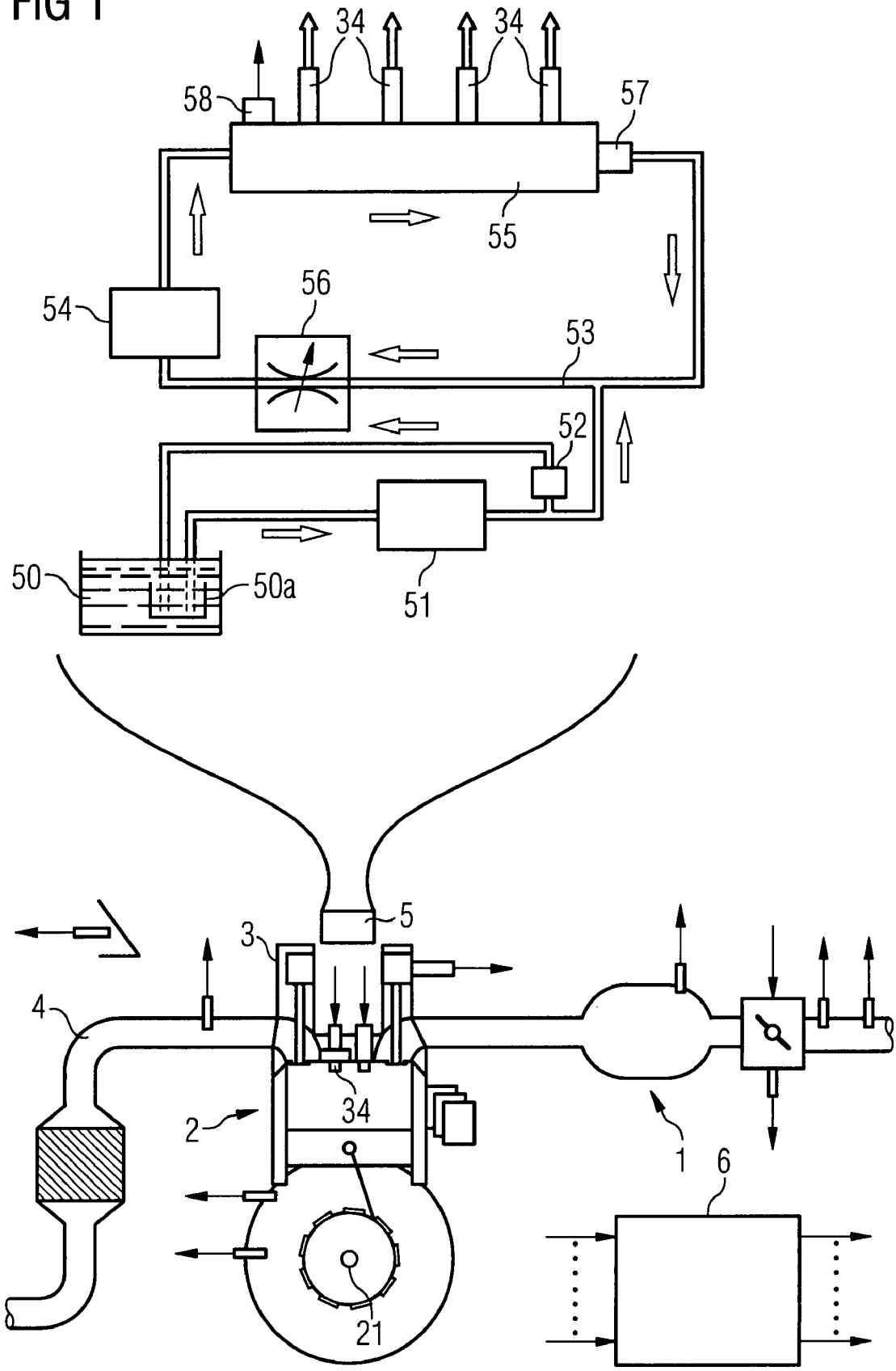
FIG. 1 shows an internal combustion engine comprising a fuel supplying device.

An internal combustion engine (FIG. 1) comprises an intake duct 1, a motor unit 2, a cylinder head 3 and an exhaust gas duct 4. The motor block 2 comprises a plurality of cylinders which have pistons and connecting rods via which they are coupled to a crankshaft 21.

The cylinder head 3 comprises a valve train assembly comprising a gas inlet valve, a gas outlet valve and valve operating mechanisms. The cylinder head 3 also comprises an injection valve 34 and a spark plug.

A supplying device 5 for fuel is also provided. This comprises a fuel tank 50 which is connected via a first fuel line to a low-pressure pump 51. The fuel line ends in a swirl pot 50*a*. At the output side the low-pressure pump 51 is actively connected to an admission 53 of a high-pressure pump 54. A mechanical regulator 52, which is connected at the output-side to the fuel tank 50 via an additional fuel line, is also provided at the output-side of the low-pressure pump 51. The low-pressure pump 51, the mechanical regulator 52, the fuel line, the additional fuel line and the admission 53 form a low-pressure circuit.

The low-pressure pump 51 is preferably configured in such a way that during operation of the internal combustion engine it always supplies an adequate volume of fuel to ensure that a specified low pressure is not fallen below.

The admission 53 is guided to the high-pressure pump 54 which at the output side conveys the fuel toward a fuel accumulator 55. The high-pressure pump 54 is usually driven by the camshaft and thus conveys a constant volume of fuel into the fuel accumulator 55 with a constant speed of the crankshaft 21.

The injection valves 34 are actively connected to the fuel accumulator 55. The fuel is thus supplied to the injection valves 34 via the fuel accumulator 55.

In the approach of the high-pressure pump 54, i.e. upstream of the high-pressure pump 54, a volume flow control valve 56 is provided by means of which the volume flow that is supplied to the high-pressure pump 54 may be adjusted. A specified fuel pressure FUP_SP in the fuel accumulator 55 can be adjusted by corresponding control of the volume flow control valve 56.

The fuel supplying device 5 is also provided with an electromagnetic pressure regulator 57 at the output side of the fuel accumulator 55 and with a return line into the low-pressure circuit. If a fuel pressure in the fuel accumulator 55 is greater than the fuel pressure FUP_SP specified by corresponding control of the electromechanical pressure regulator 57, the electromechanical pressure regulator 57 opens and fuel is discharged from the fuel accumulator 55 into the low-pressure circuit.

Alternatively the volume flow control valve 56 may also be integrated in the high-pressure pump 54 or the electromechanical pressure regulator 57 and the volume flow control valve 56 are adjusted via a common actuator, as is illustrated by way of example in FIG. 2 and described in more detail below.

The internal combustion engine is associated with a control device 6 which is in turn associated with sensors which detect various measured quantities and determine the measured value of the measured quantities in each case. As a function of at least one of the measured quantities the control device 6 determines regulating variables which are then converted into corresponding regulating signals to control actuators by means of corresponding final controlling elements.

The sensors are for example a pedal position sensor which detects the position of an accelerator pedal, a crankshaft angle sensor which detects a crankshaft angle and with which a motor speed is then associated, an airflow measuring device and a fuel pressure sensor 58 which detects a fuel pressure FUP_AV in the fuel accumulator 55. Any desired subset of sensors or additional sensors may be present depending on the embodiment of the invention.

The actuators are constructed for example as gas inlet or gas outlet valves, injection valves 34, a spark plug, throttle valve, low-pressure pump 51, volume flow control valve 56 or as an electromechanical pressure regulator 57.

The internal combustion engine preferably also has additional cylinders with which appropriate final controlling elements are then associated.

Figure 2:
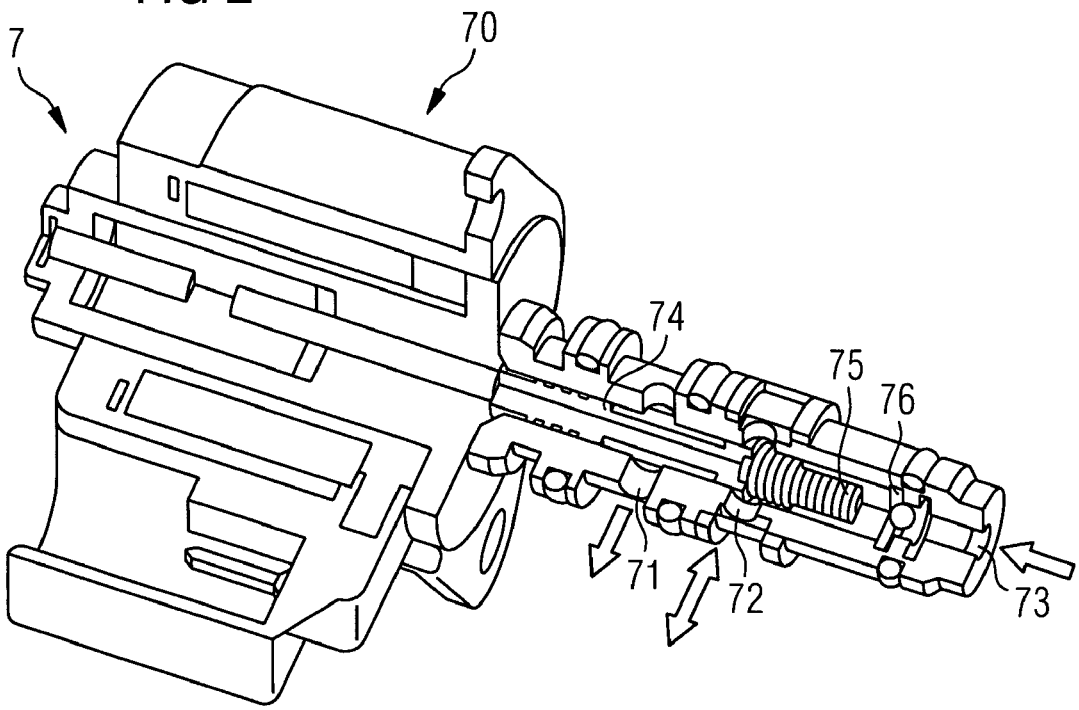
FIG. 2 shows a combination valve comprising a volume flow control valve and an electromechanical pressure regulator with a common actuator.

FIG. 2 shows a combination valve 7 comprising an actuator 70, the volume flow control valve 56 and the electromechanical pressure regulator 57. The combination valve 7 has an outlet 71 which is actively connected to the inlet of the high-pressure pump 54, a connector 72 which is actively connected to the admission 53 and an inlet 73 which is actively connected to the fuel accumulator 55. The volume flow control valve 56 comprises the connector 72, the outlet 71, a valve positioner 74 and the actuator 70. The electromechanical pressure regulator 57 comprises the inlet 73, the connector 72, the valve positioner 74, a spring 75, a valve cap 76 and the actuator 70.

The actuator 70 moves the valve positioner 74 in the axial direction as a function of a regulating signal PWM. The spring 75 is arranged between the valve positioner 74 and the valve cap 76 and pre-stressed as a function of the axial position of the valve positioner 74. The valve positioner 74 is constructed in such a way that in the region of a first axial displacement of the valve positioner 74 in the direction of the spring 75, starting form its axial position in which it is pressed by the spring 75, without loading of the actuator 70 with the regulating signal PWM, the flow of fuel is substantially cut off. In this state only a leakage flow flows from the connector 72 to the outlet 71. In the region of a second axial displacement of the valve positioner 74 by corresponding loading of the actuator 70 with the regulating signal PWM the connector 72 is hydraulically coupled to the outlet 71. In the second region of the axial displacement of the valve positioner 74 a volume flow of a different magnitude can flow from the admission 53 into the connector 72 toward the outlet 71 and to the high-pressure pump 54 as a function of the regulating signal PWM.

If the force caused by the fuel pressure in the fuel accumulator 55 is greater than the force caused by the pre-stressing of the spring and exerted on the valve cap 76, the inlet 73 is hydraulically coupled to the connector 72, so fuel can flow from the fuel accumulator 55 into the inlet 73 toward the outlet 72 into the admission 53.

The fuel pressure in the fuel accumulator 55, which is at least required to open the electromechanical pressure regulator, can be adjusted by increasing or reducing the regulating signal PWM. The actuator 70 increases or reduces the force accordingly which acts via the valve positioner 74 on the spring 75 and pre-stresses the spring 75. The force caused by prestressing of the spring 75 closes the electromechanical pressure regulator if the force exerted on the valve cap 76 by the fuel pressure in the fuel accumulator 55 is smaller.

Figure 3:
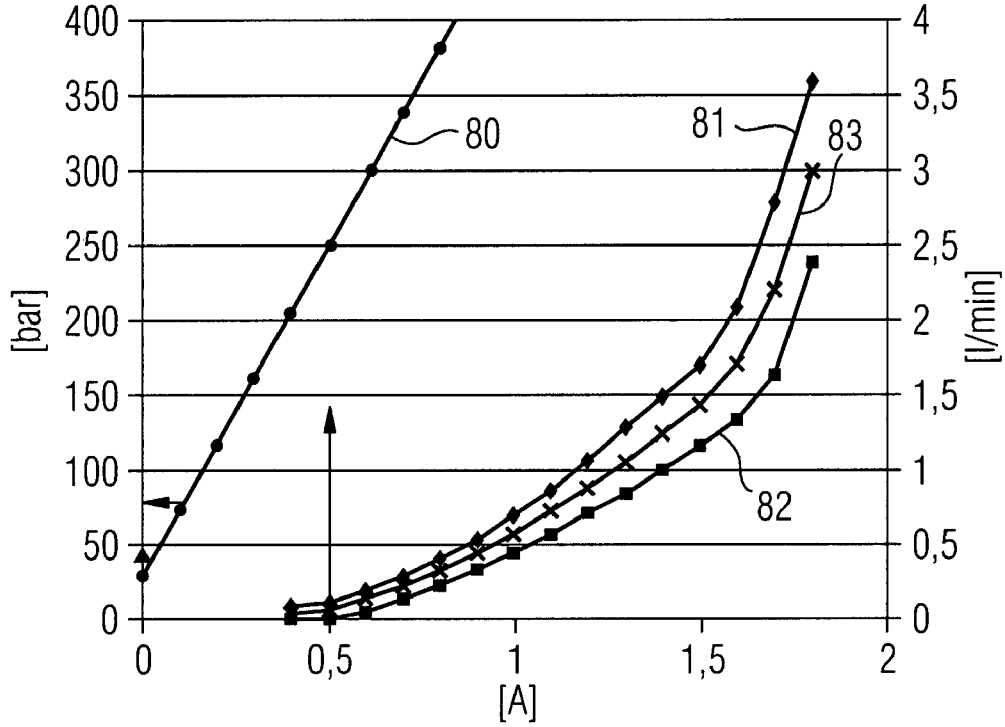
FIG. 3 shows the characteristic of the combination valve of FIG. 2.

FIG. 3 shows characteristics of the combination valve 7 illustrated in FIG. 2. A pressure curve 80 shows the connection between the regulating signal PWM in amps and the fuel pressure in the fuel accumulator 55 in bar. If with the given regulating signal PWM the fuel pressure in the fuel accumulator 55 is increased beyond the value specified by the pressure curve 80, the electromechanical pressure regulator 57 opens and reduces the fuel pressure in the fuel accumulator 55 by discharging fuel from the fuel accumulator 55 into the admission 53.

For values of the regulating signal PWM that are greater than a threshold value, which in this embodiment has a value of about 0.5 amp, the volume flow control valve 56 opens and allows a flow of fuel given in liters per minute. The graph shows an upper flow curve 81 which represents an upper tolerance limit for the combination valve 7, a lower flow curve 82 which represents a lower tolerance limit for the combination valve 7, and a middle flow curve 83 which represents the average value between upper and lower flow curves. The flow curves 81, 82 and 83 show that in this embodiment the leakage flow may still flow below the threshold value, i.e. if the volume flow control valve 56 is substantially closed.

Figure 4:
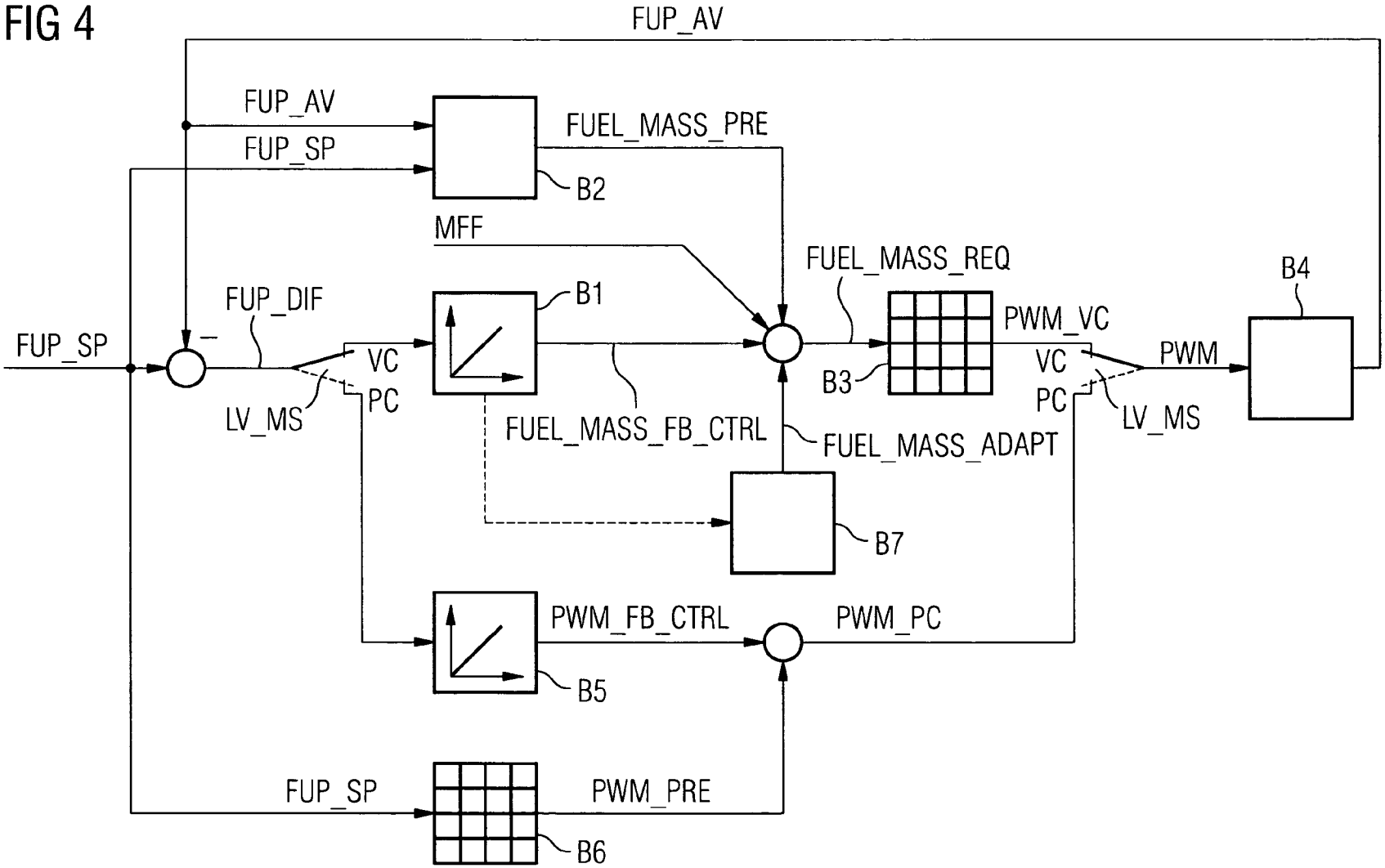
FIG. 4 shows the block diagram of a regulating device for regulating the fuel pressure in a fuel accumulator.

FIG. 4 shows a block diagram of a regulating device which may be used for regulating the fuel pressure in the fuel supplying device 5 and comprises a combination valve 7, as is described by way of example in FIG. 2. The fuel pressure in the fuel accumulator 55 is regulated as a function of the current operating mode of the fuel supplying device 5.

In a first operating mode the fuel pressure in the fuel accumulator 55 is adjusted as a function of the volume of fuel conveyed by the high-pressure pump 54. The volume flow control valve 56 is open and the conveyed volume of fuel is dependent on the control of the volume flow control valve 56. In this operating mode the electromechanical pressure regulator 57 is closed. If more fuel is conveyed into the fuel accumulator 55 than is appropriate the fuel pressure in the fuel accumulator 55 increases. If less fuel is conveyed into the fuel accumulator 55 than is appropriate the fuel pressure in the fuel accumulator 55 sinks accordingly. This first operating mode is called volume control VC.

In a second operating mode the volume flow control valve 56 is closed. Only the leakage flow flows through the volume flow control valve 56. If the electromechanical pressure regulator 57 is closed and less fuel is dosed than is conveyed into the fuel accumulator 55 than via the leakage flow, the fuel pressure in the fuel accumulator 55 increases until the electromechanical pressure regulator 57 opens and the flow of fuel into the admission 53 is stopped. The fuel pressure in the fuel accumulator 55 is consequently limited to the fuel pressure specified by the electromechanical pressure regulator 57. This second operating mode is therefore called pressure control PC.

FIG. 4 shows two control circuits which can be switched between by means of a switch LV_MS as a function of the currently adjusted operating mode of the fuel supplying device 5. If the currently adjusted operating mode is the first operating mode, i.e. volume control VC, the switch LV_MS is then in the position VC. If the currently adjusted operating mode is the second operating mode, i.e. pressure control PC, then the switch LV_MS is in the position PC.

A control deviation FUP_DIF is determined from the difference between the specified fuel pressure FUP_SP and the detected fuel pressure FUP_AV. The control deviation FUP_DIF is supplied to a regulator in block B1 in the case of volume control VC. This regulator is preferably constructed as a PI regulator. A regulator value FUEL_MASS_FB_CTRL of the first regulator is determined in block B1. A pre-control value FUEL_MASS_PRE of the mass of fuel to be conveyed is determined in block B2 as a function of the specified fuel pressure FUP_SP and the detected fuel pressure FUP_AV. The pre-control value FUEL_MASS_PRE of the mass of fuel to be conveyed, the regulator value FUEL_MASS_FB_CTRL of the first regulator and the mass of fuel MFF to be injected and an adaptation value FUL_MASS_ADAPT are added up to give a mass of fuel to be conveyed FUEL_MASS_REQ. In the case of volume control VC a regulating signal PWM_VC is determined in a block B3 as a function of the mass of fuel to be conveyed FUEL_MASS REQ. Block B3 preferably comprises performance data. A block B4 represents the fuel supplying device 5 illustrated in FIG. 1 with the combination valve 7 shown in FIG. 2. The regulating signal PWM, which in the case of volume control VC is the same as the regulating signal PWM_VC, is the input variable of block B4. The output variable of block B4 is the detected fuel pressure FUP_AV which is detected for example by means of the fuel pressure sensor 58.

In the case of pressure control PC, the control deviation FUP_DIF is supplied to a second regulator in a block B5. The regulator in block B5 preferably constructed as a PI regulator. In a block B6 a pre-control value PWM_PRE for a regulating signal PWM_PC in the case of pressure control PC is determined as a function of the specified fuel pressure FUP_SP, to which is added a regulator value PWM_FB_CTRL of the second regulator determined in block B5. The total is the regulating signal PWM_PC in the case of pressure control PC. In the case of pressure control PC the regulating signal PWM is the same as the regulating signal PWM_PC in the case of pressure control PC. The block B6 preferably comprises performance data.

The adaptation value FUEL_MASS_ADAPT is determined in block B7 as a function of a regulator state of the first regulator in block B1. For example a value of an integral fraction of the first regulator may be reduced by a value and the adaptation value corrected as a function of this value if a specified operating condition, for example a stationary operating state, exists.

The performance data of blocks B3 and B6 are preferably determined in advance by way of experiments on an engine test stand, simulations or road trials. Alternatively functions based on physical models may also be used for example.

The block diagram shown in FIG. 4 is a preferred embodiment of a regulating device for a fuel supplying device 5, comprising a combination valve 7 according to FIG. 2 and characteristics according to FIG. 3. If the volume flow control valve 56 and the electromechanical pressure regulator 57 each have their own actuator however, the regulating signal PWM_VC acts on the actuator of the volume flow control valve 56 in the case of volume control VC and the regulating signal PWM_PC acts on the actuator of the electromechanical pressure regulator 57 in the case of pressure control PC. Consequently both the regulating signal PWM_VC in the case of volume control VC and the regulating signal PWM_PC in the case of pressure control PC are supplied to block B4 instead of the common regulating signal PWM. The control circuits for the first and second operating modes preferably operate simultaneously in this case, so the switch LV_MS shown in FIG. 4 may be omitted. The control deviation FUP_DIF is supplied to blocks B1 and B5 simultaneously.

Figure 5:
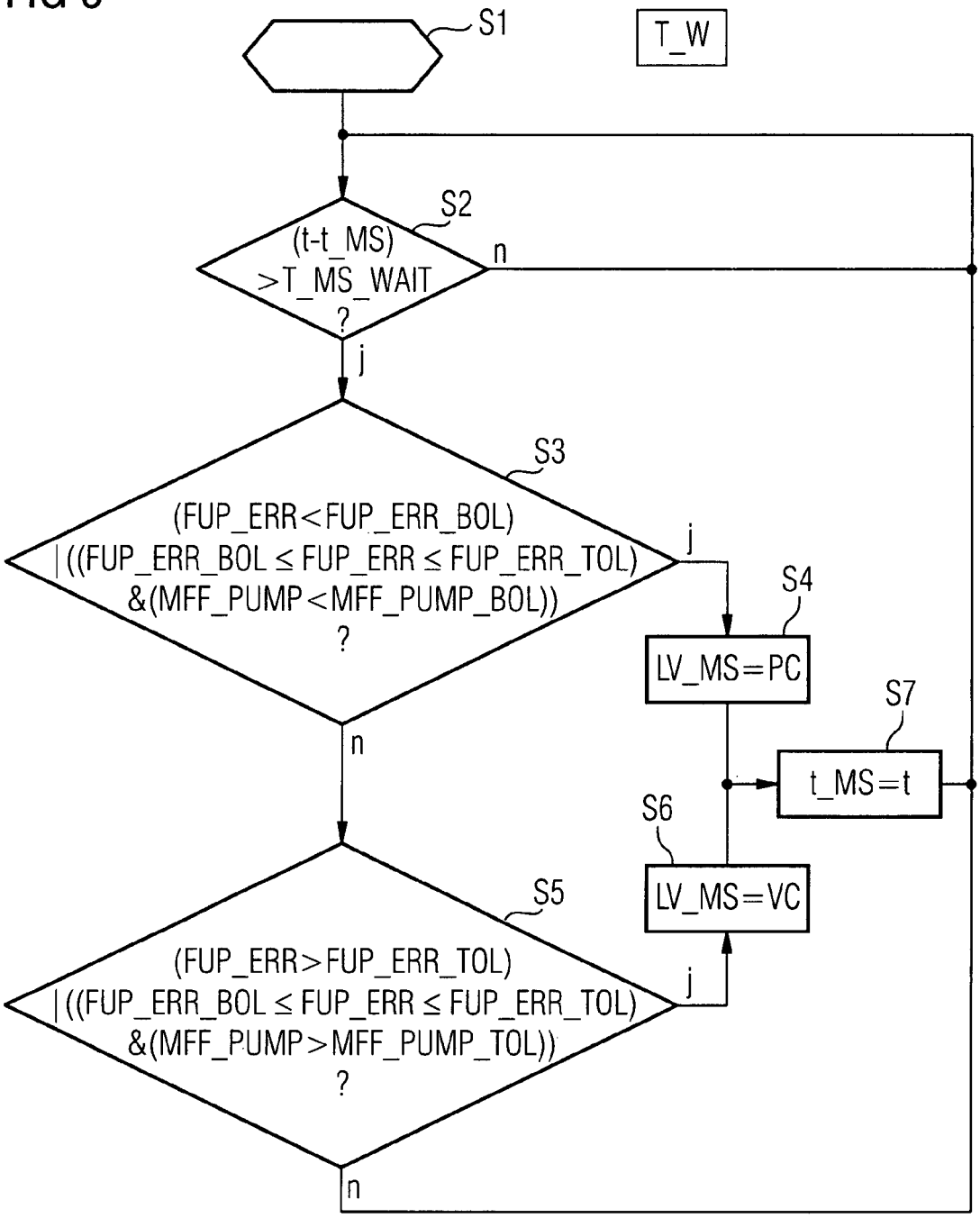
FIG. 5 shows a flow diagram for controlling the switch-over of fuel supplying device operating states.

FIG. 5 shows a flow diagram illustrating control of the operating mode switch-over of the fuel supplying device 5. Processing starts with step S1 which is preferably executed when the internal combustion engine starts. Step S1 may include additional steps, not shown here, such as initialization of variables to establish a defined initial state of the fuel supplying device 5.

A check is carried out in step S2 as to whether a difference between a current time t and a time t_MS of the last operating mode switch-over is greater than a blocking time T_MS_WAIT. If this condition is not satisfied step S2 is repeated after a waiting time T_W. Since the last operating mode switch-over therefore at least the blocking time T_MS_WAIT must have elapsed before the operating mode can be switched again. If the condition is satisfied in step S2 however, processing continues in step S3.

In step S3 both an error value FUP_ERR of the fuel pressure and a delivery flow MFF_PUMP of the high-pressure pump 54 are checked. The error value FUP_ERR of the fuel pressure is dependant on a value or a factor by which the detected fuel pressure FUP_AV is greater or less than the specified fuel pressure FUP_SP and is defined in this embodiment such that the error value FUP_ERR of the fuel pressure is greater if the specified fuel pressure FUP_SP is greater than the detected fuel pressure FUP_AV, as if the specified fuel pressure FUP_SP is less than the detected fuel pressure FUP_AV. The error value FUP_ERR of the fuel pressure is for example a quotient from the specified fuel pressure FUP_SP and the detected fuel pressure FUP_AV or the difference between the specified fuel pressure FUP_SP and the detected fuel pressure FUP_AV. If the error value FUP_ERR of the fuel pressure is less than a specified lower tolerance limit FUP_ERR_BOL for the error value FUP_ERR of the fuel pressure or if the error value FUP_ERR of the fuel pressure is greater than or equal to the specified lower tolerance limit FUP_ERR_BOL for the error value FUP_ERR of the fuel pressure and less than or equal to a specified upper tolerance limit FUP_ERR_TOL for the error value FUP_ERR of the fuel pressure, and if the delivery flow MFF_PUMP of the high-pressure pump 54 is simultaneously less than a lower switch-over threshold MFF_PUMP_BOL of the delivery flow MFF_PUMP of the high-pressure pump 54, processing continues in step S4 in which the operating mode of the fuel supplying device 5 is switched to pressure-control mode PC. If the condition is not satisfied in step S3, step S5 is carried out.

The error value FUP_ERR of the fuel pressure and the delivery flow MFF_PUMP of the high-pressure pump 54 are again checked in step S5. If the error value FUP_ERR of the fuel pressure is greater than a specified upper tolerance limit FUP_ERR_TOL for the error value FUP_ERR of the fuel pressure or if the error value FUP_ERR of the fuel pressure is greater than or equal to the specified lower tolerance limit FUP_ERR_BOL for the error value FUP_ERR of the fuel pressure and less than or equal to the specified upper tolerance limit FUP_ERR_TOL for the error value FUP_ERR of the fuel pressure and if the delivery flow MFF_PUMP of the high-pressure pump 54 is simultaneously greater than an upper switch-over threshold MFF_PUMP_TOL of the delivery flow MFF_UMP of the high-pressure pump 54, processing continues in step S6 in which the operating mode of the fuel supplying device 5 is switched to volume-control mode VC. If the condition is not satisfied in step S5, processing continues with step S2 following a waiting time T_W.

After switching over the operating mode in step S4 or step S6, step S7 is in each case carried out in which the current time t is stored as the time of the last operating mode switchover t_MS if a switch was made before from the first operating mode to the second operating mode or from the second operating mode to the first operating mode. Following step S7 processing continues, again after a waiting time T_W, in step S2.

The lower switch-over threshold MFF_PUMP_BOL and the upper switch-over threshold MFF_PMP_TOL of the delivery flow MFF_PUMP of the high-pressure pump 54 may be determined as a function of the leakage flow of the volume flow control valve 56 and a possible leakage flow from the fuel accumulator 55, so tolerances and potential errors and defects in components of the fuel supplying device 5 may be compensated, so the high-pressure pump 54 needs convey only as little fuel as possible, but as much fuel as is necessary, into the fuel accumulator 55.

Figure 6:
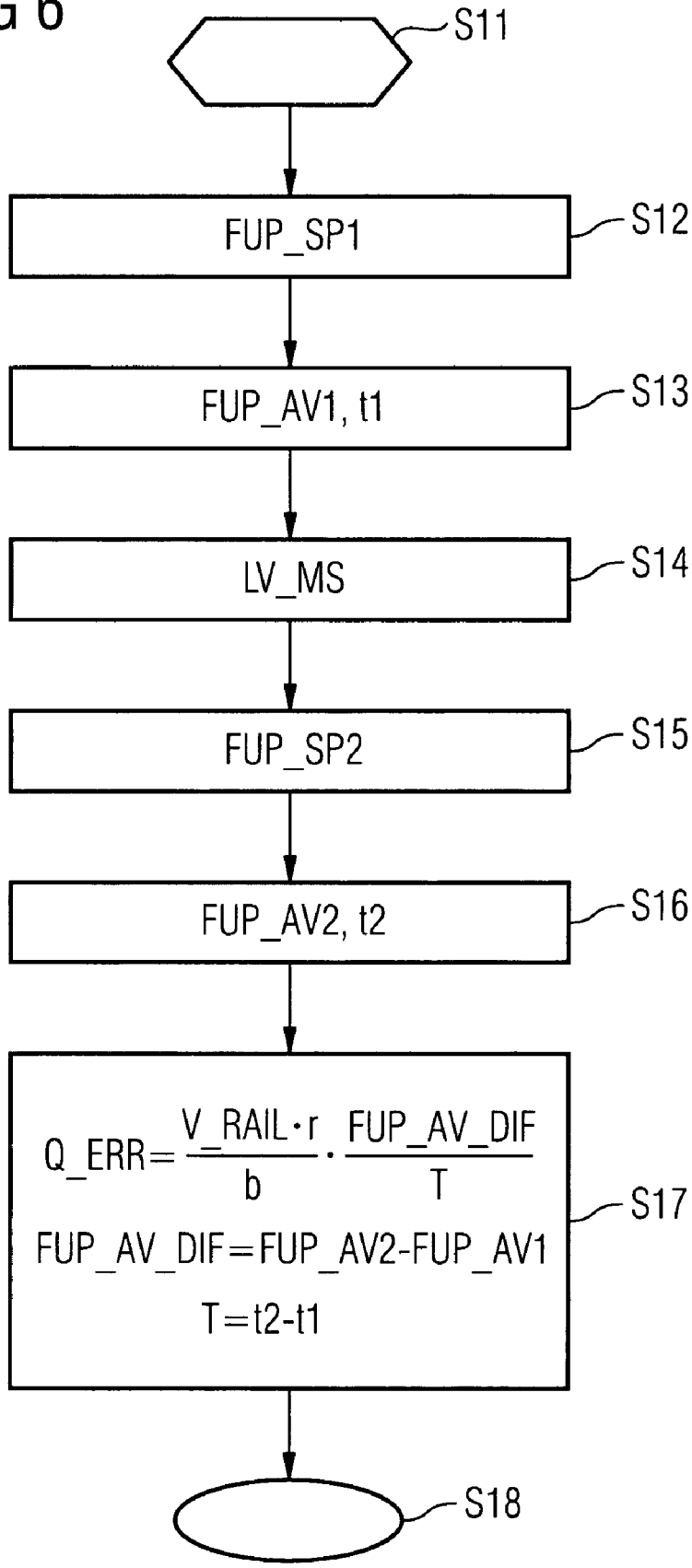
FIG. 6 shows a flow diagram for determining the error value of the flow of fuel.

FIG. 6 shows a flow diagram showing the steps for determining an error value Q_ERR of the flow of fuel in the fuel supplying device 5. Processing starts with step S1 which is preferably executed if the internal combustion engine is in coasting mode, in other words if the crankshaft 21 is turning without fuel being dosed. Step S11 may also include additional preparatory steps, not shown here. A first fuel pressure FUP_SP1 is set in step S12. The first fuel pressure FUP_SP1 is preferably less than the current fuel pressure in the fuel accumulator 55. Once the first fuel pressure FUP_SP1 is set such that the amount of the control deviation FUP_DIF is less than a specified threshold value a first fuel pressure FUP_SV1 and a first time t1 are detected in step S13. A third operating mode of the fuel supplying device 5 is subsequently set in step S14 and the operating mode is simultaneously prevented from being automatically switched.

In the third operating mode all valves of the fuel supplying device 5 are controlled in such a way that they are closed.

This operating mode can be set for example in that a switch is made to pressure-control mode PC and at the same time the specified fuel pressure FUP_SP is set to a value that is large enough for the electromechanical pressure regulator 57 to be closed. In the pressure control mode PC the volume flow control valve 56 is controlled in such a way that it is closed. The injection valves 34 are also controlled in such a way that they are closed as no fuel is to be dosed. Changes in the fuel pressure in the fuel accumulator 55 can therefore only be caused as a result of the leakage flow of the volume flow control valve 56 or by the possible leakage flow from the fuel accumulator 55.

There is a wait in step S15 until the fuel pressure in the fuel accumulator is greater than or equal to a second specified fuel pressure FUP_SP2 or until a specified time has elapsed. A second fuel pressure FUP_AV2 and a second time t2 are detected in step S16. A difference FUP_AV_DIF between the second detected fuel pressure FUP_AV2 and the first detected fuel pressure FUP_AV1 and a time T from the second time t2 and the first time t1 are determined in step S17. The error value Q_ERR of the flow of fuel is determined as a function of the difference FUP_AV_DIF of the detected fuel pressures and time T. The error value Q_ERR of the flow of fuel may also be determined as a function of a volume V_RAIL of the fuel accumulator 55, a fuel density r and a fuel compressibility b. The error value Q_ERR of the flow of fuel represents the balance of the inflows of fuel into the fuel accumulator 55 and the fuel discharges from the fuel accumulator 55 if all valves of the valve supplying device 5 are controlled in such a way that the valves should be closed.

The third operating mode is switched off in step S18 and there is a switch to the operating mode switch-over described in FIG. 5. The identified error value Q_ERR of the flow of fuel may, preferably following a check for possible errors and defects in the fuel supplying device 5, be incorporated into control of the fuel supplying device 5. The identified error value Q_ERR in the flow of fuel can therefore be taken into account during continued operation of the fuel supplying device 5.

The invention claimed is:

1. A method for controlling a fuel supplying device of an internal combustion engine, comprising:

connecting a fuel input to a high-pressure fuel pump having a volume flow control valve to a low-pressure fuel circuit;

pressurizing the fuel by the high-pressure fuel pump;

delivering the pressurized fuel into a fuel accumulator;

connecting an electromechanical pressure regulator to the fuel accumulator and the low-pressure fuel circuit where the electromechanical pressure regulator is configured to stop the flow of fuel from the fuel accumulator into the low-pressure fuel circuit;

determining a control deviation from a difference between a specified fuel pressure and a detected fuel pressure;

generating in a first operating mode a regulating signal for the volume flow control valve by a first regulator;

providing in the first operating mode the control deviation to the first regulator;

generating in a second operating mode a regulating signal for the electromechanical pressure regulator by a second regulator;

providing in the second operating mode the control deviation to the second regulator;

switching from the first operating mode to the second operating mode if the detected fuel pressure is greater than the specified fuel pressure by a first specified amount or a first specified factor;

switching from the first operating mode to the second operating mode if the delivery flow of the high-pressure pump is less than a lower switch-over threshold of the delivery flow; and switching from the second operating mode to the first operating mode if the delivery flow of the high-pressure pump is greater than an upper switch-over threshold of the delivery flow.

2. The method as claimed in claim 1, wherein a changeover from the second operating mode to the first operating mode occurs if the detected fuel pressure is less than the specified fuel pressure by a second specified amount or a second specified factor.

3. The method as claimed in claim 1, wherein the lower switch-over threshold of the delivery flow and the upper switch-over threshold of the delivery flow are determined from an error value of a leakage flow through the volume flow control valve in a closed position and a leakage flow from the fuel accumulator if the electromechanical pressure regulator is closed.

4. A method for controlling a fuel supplying device of an internal combustion engine, comprising:

connecting a fuel input to a high-pressure fuel pump having a volume flow control valve to a low-pressure fuel circuit;

pressurizing the fuel by the high-pressure fuel pump;

delivering the pressurized fuel into a fuel accumulator;

connecting an electromechanical pressure regulator to the fuel accumulator and the low-pressure fuel circuit where the electromechanical pressure regulator can stop the flow of fuel from the fuel accumulator into the low-pressure fuel circuit;

determining a control deviation from a difference between a specified fuel pressure and a detected fuel pressure;

generating in a first operating mode a regulating signal for the volume flow control valve by a first regulator;

providing in the first operating mode the control deviation to the first regulator;

generating in a second operating mode a regulating signal for the electromechanical pressure regulator by a second regulator;

providing in the second operating mode the control deviation to the second regulator;

switching from the second operating mode to the first operating mode if the detected fuel pressure is less than the specified fuel pressure by a second specified amount or a second specified factors;

switching from the first operating mode to the second operating mode if the delivery flow of the high-pressure pump is less than a lower switch-over threshold of the delivery flow; and switching from the second operating mode to the first operating mode if the delivery flow of the high-pressure pump is greater than an upper switch-over threshold of the delivery flow.

5. The method as claimed in claim 4, wherein the lower switch-over threshold of the delivery flow and the upper switch-over threshold of the delivery flow are determined from an error value of a leakage flow through the volume flow control valve in a closed position and a leakage flow from the fuel accumulator if the electromechanical pressure regulator is closed and no fuel is delivered.

6. The method as claimed in claim 5, wherein:

the error value of the flow of fuel is determined as a function of a plurality of fuel pressures detected at different times and are detected in a third operating mode where no fuel is delivered, and the volume flow control valve and the electromechanical pressure regulator are controlled in such a way that the volume flow control valve arid the electromechanical pressure regulator are closed.

7. The method as claimed in claim 6, wherein:

the fad pressure in the fuel accumulator is regulated to a first specified fuel pressure such that the control deviation is less than a specified threshold value, a first fuel pressure is detected, the third operating mode is adjusted and the operating mode switch-over is blocked, a second fuel pressure is detected, and the error value of the flow of fuel is determined as a function of a time and a difference between the second detected fuel pressure and the first detected fuel pressure.

8. The method as claimed in claim 7, wherein the second fuel pressure is detected if the fuel pressure in the fuel accumulator is greater than or equal to a second specified fuel pressure, of which the value is greater than that of the first specified fuel pressure.

9. The method as claimed in claim 8, wherein the second fuel pressure is detected after a specified time has elapsed.

10. The method as claimed in claim 9, wherein following a switch from the first operating mode to the second operating mode or from the second operating mode to the first operating mode switch-over of the operating mode is blocked for at least one specified blocking time.

11. A method for controlling a fuel supplying device of an internal combustion engine, comprising:

connecting a fuel input to a high-pressure fuel pump having a volume flow control valve to a low-pressure fuel circuit;

pressurizing the fuel by the high-pressure fuel pump;

delivering the pressurized fuel into a fuel accumulator;

connecting an electromechanical pressure regulator to the fuel accumulator and the low-pressure fuel circuit where the electromechanical pressure regulator can stop the flow of fuel from the fuel accumulator into the low-pressure fuel circuit;

determining a control deviation from a difference between a specified fuel pressure and a detected fuel pressure;

generating in a first operating mode a regulating signal for the volume flow control valve by a first regulator;

providing in the first operating mode the control deviation to the first regulator;

generating in a second operating mode a regulating signal for the electromechanical pressure regulator by a second regulator;

providing in the second operating mode the control deviation to the second regulator; and performing a mode switch selected from the group consisting of:

(a) switching from the first operating mode to the second operating mode if the detected fuel pressure is greater than the specified fuel pressure by a first specified amount or a first specified factor, (b) switching from the first operating mode to the second operating mode if the delivery flow of the high-pressure pump is less than a lower switch-over threshold of the delivery flow, and (c) switching from the second operating mode to the first operating mode if the delivery flow of the high-pressure pump is greater than an upper switch-over threshold of the delivery flow, wherein the lower switch-over threshold of the delivery flow and the upper switch-over threshold of the delivery flow are determined from an error value of a leakage flow through the volume flow control valve in a closed position and a leakage flow from the fuel accumulator if the electromechanical pressure regulator is closed and no fuel is to be delivered.

12. The method as claimed in claim 11, wherein there is a switch from the second operating mode to the first operating mode if the detected fuel pressure is less than the specified fuel pressure by a second specified amount or a second specified factor.

13. The method as claimed in claim 11, wherein:

the error value of the flow of fuel is determined as a function of a plurality of fuel pressures detected at different times and are detected in a third operating mode where no fuel is delivered, and the volume flow control valve and the electromechanical pressure regulator are controlled in such a way that the volume flow control valve and the electromechanical pressure regulator are closed.

14. The method as claimed in claim 11, wherein:

the fuel pressure in the fuel accumulator is regulated to a first specified fuel pressure such that the control deviation is less than a specified threshold value, a first fuel pressure is detected, the third operating mode is adjusted and the operating mode switch-over is blocked, a second fuel pressure is detected, and the error value of the flow of fuel is determined as a function of a time and a difference between the second detected fuel pressure and the first detected fuel pressure.

15. The method as claimed in claim 14, wherein the second detected fuel pressure is detected if the fuel pressure in the fuel accumulator is greater than or equal to a second specified fuel pressure, of which the value is greater than that of the first specified fuel pressure.

16. The method as claimed in claim 15, wherein the second fuel pressure is detected after a specified time has elapsed.

17. The method as claimed in claim 16, wherein following a switch from the first operating mode to the second operating mode or from the second operating mode to the first operating mode switch-over of the operating mode is blocked for at least one specified blocking time.

* * * * *